United States Patent [19]

Hikota et al.

[11] Patent Number: 4,769,924

[45] Date of Patent: Sep. 13, 1988

[54] LIQUID ABSORBING APPARATUS

[75] Inventors: Toyohiko Hikota, Toyohashi; Shigeki Iwamoto, Ashikaga; Minoru Tanaka; Tatsuo Kimura, both of Gifu; Masao Masuda, Nagoya, all of Japan

[73] Assignees: Toray Industries, Inc., Tokyo; Masuda Seisakusho Company Limited, Aichi, both of Japan

[21] Appl. No.: 23,167

[22] PCT Filed: May 16, 1986

[86] PCT No.: PCT/JP86/00251

§ 371 Date: Jan. 15, 1987

§ 102(e) Date: Jan. 15, 1987

[87] PCT Pub. No.: WO86/06766

PCT Pub. Date: Nov. 20, 1986

[30] Foreign Application Priority Data

May 17, 1985 [JP] Japan ..... 60-104023

[51] Int. Cl.[4] ..... F26B 13/26

[52] U.S. Cl. ..... 34/95; 15/306 B

[58] Field of Search ..... 34/115, 95, 95.3, 112, 34/118; 15/306 B, 97 B, DIG. 2

[56] References Cited

U.S. PATENT DOCUMENTS 4,250,591 2/1981 Mello ..... 34/243 C 4,556,450 12/1985 Chuang et al. ..... 34/95.3

*Primary Examiner*—Henry A. Bennet

*Attorney, Agent, or Firm*—Armstrong, Nikaido, Marmelstein & Kubovcik

[57] ABSTRACT

A liquid absorbing apparatus comprises a liquid absorption part provided with a fibrous sheet comprising a nonwoven fabric composed of three-dimensionally interlaced fibers and having a high-polymeric elastic material impregnated in cavities of the nonwoven fabric. The liquid absorption part is provided with a suction mechanism for suctioning a liquid. This apparatus has a remarkable liquid absorption power and a remarkable retentivity of the absorption power, and enables a uniform squeezing of a liquid. It is effectively useful for or in removing liquid deposited on or contained in such as a metal product, a fiber product, a ground floor and so forth to clean them.

13 Claims, 2 Drawing Sheets

LIQUID ABSORBING APPARATUS

TECHNICAL FIELD

The present invention relates to a liquid absorbing apparatus. More particularly, the invention pertains to a liquid absorbing apparatus having an initial liquid absorption power and a retentivity of this power which are both remarkable.

BACKGROUND ART

For the prior art apparatus for removing a liquid from objects which either contain the liquid therein or bear it thereon, there is known with reference to for example Japanese utility model publication No. 50-10012 a liquid absorption roller having applied over its roller surface by adhesion with a covering of a fibrous sheet comprising such a nonwoven mat in which fibers are three-dimensionally interlaced and a polymer is impregnated in cavities thereof to provide a continuous and microporous structure.

This liquid absorption apparatus has an exceeding initial liquid absorption power in comparison to such liquid absorption rollers which have their surfaces covered with natural sponge, a paper made of natural or synthetic fibers, an ordinary felt or the like. However, it has a shortcoming such that since there lies a limitation with respect to the thickness in which the fibrous sheet can be produced, its liquid absorption power or capacity becomes considerably lowered after its use for some time. To overcome the shortcoming, it may be devised to provide such a liquid absorption roller which has plies of the fibrous sheet wound on the roller surface. Then, although the retentivity of the absorption power may possibly be more or less improved, another difficulty is met such that the structural durability of the roller is far from being adequate. Further, if it is then made to apply an adhesive agent to plies of the fibrous sheet wound on the roller surface in order to overcome the difficulty, a fresh problem is posed such that the flow or migration of liquid through the fibrous sheet is obstructed, whereby it can no longer be expected to attain the very sought-for enhancement of the retentivity of the liquid absorption power.

Then, with reference to Japanese patent application Kokai (=laying-open) publication No. 59-53764, thereby such a nonwoven fabric roller device is known, which comprises a roller body provided with many plies of a nonwoven fabric which are piled one on another in a compressed manner, and an inner suction mechanism. This device is improved over the above considered absorption rollers of the prior art in that it can effect a suction of liquid, but it still is not fully satisfactory in that it cannot at once remove a whole of the liquid or liquid matter present on or in an object to be treated for removal of the liquid or liquid matter.

The primary object of the present invention is to provide a liquid absorbing apparatus which is remarkable in respect of the liquid absorption power and its retentivity and which can make it possible to squeeze liquid uniformly.

DISCLOSURE OF THE INVENTION

To attain the above object, the present invention provides a liquid absorbing apparatus characterized by comprising a liquid absorption part and a suction mechanism, the liquid absorption part being provided with a fibrous sheet which comprises a non-woven fabric composed of three-dimensionally interlaced fibers and a high polymer elastic material impregnated in cavities of the nonwoven fabric and the suction mechanism being provided with the liquid absorption part, so as to absorb liquid into the liquid absorption part.

BEST MODE FOR CARRYING OUT THE INVENTION

Figure 1:
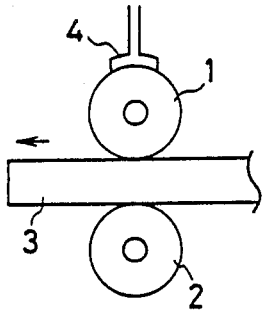
FIG. 1 is a side elevational view, showing an embodiment of the liquid absorbing apparatus according to the present invention.

The liquid absorbing apparatus according to the present invention comprises a liquid absorption part, which makes use of a fibrous sheet of such a structure which comprises a nonwoven fabric containing three-dimensionally interlaced fibers and a high-polymeric elastic material impregnated in the cavities in the nonwoven fabric, and with which a suction mechanism is operatively associated. Therefore, using the apparatus, it is feasible to effectively take advantage of the so-called capillary phenomenon due to a number of micropores which the fibrous sheet inherently possesses and, with the migration of a liquid through the apparatus permitted to take place smoothly, enhance both of the liquid absorption power and the retentivity of such power. From the viewpoint of each of the liquid absorption capacity or power and the capacity or power retentivity, the fibrous sheet should preferably be made of a nonwoven fabric composed of three-dimensionally interlaced super-fine denier fibers Such fibrous sheet is advantageous also in that its contact with objects to be treated can take place very softly and uniformly as well, so that squeezing of liquid from the objects to be treated can be evenly or uniformly effected. The fibrous sheet, which contains three-dimensionally interlaced numerous fibrous bundles composed of super-fine fibers, is more preferable from the viewpoint of each of the liquid absorption power and the power retentivity, it being considered that the capillary action can be more fully exhibited in this case.

The above-mentioned super-fine denier fibers are preferably of 0.4 denier and below or, more preferably, of from 0.02 to 0.4 deniers. Using such super-fine denier fibers, a remarkable result can be obtained in respect of both of the initial liquid absorption power attributable to the capillary phenomenon and the retentivity of such power owing to the migration or transfer of an absorbed liquid. If the fibers are of an excessively small denier, then it tends to occur that the liquid-holding capacity becomes lowered and such fibers are not preferable. Contrary to this, if the fibers are of an excessively large denier, then the density of the fibrous sheet comprising the fibers tends to be so high that the open spaces in the sheet for passing a liquid through becomes insufficient, when the liquid absorption power becomes lost within a relatively short period of the operation time, and such fibers are not preferable.

In or for the present invention, no particular limitation is applicable to the polymer that makes fibers in the fibrous sheet, but the polymer should preferably be polyester and polyamide.

With the fibrous sheet in or for the invention, it is required that the high-polymeric elastic material is impregnated in the cavities in the nonwoven fabric forming the fibrous sheet. The presence of the highpolymeric elastic material in the fibrous sheet can serve to maintain the elasticity of the sheet to be appropriate, and the liquid absorption power and the retentivity or the power to sustain the absorption power can be enhanced. Also, the presence the high-polymeric elastic material in the sheet takes effect in stabilizing the shape or configuration in which the fibrous sheet is formed, to result in having the use life of the liquid absorbing apparatus extended.

The content of the high-polymeric elastic material in the nonwoven fabric of the fibrous sheet should preferably be within the range of 10 to 80 wt.% (based on fibers) and, more particularly, 10 to 50 wt.% (based on the fibers). If this content exceeds 80 wt.%, the resulting fibrous sheets have a poor initial liquid absorption power, while when it does not reach 10 wt.%, the resulting sheets are poor in the elasticity and cannot have a desirably high elastic recovery ratio, and such contents are not preferable.

The fibrous sheet for or in the present invention should have an elastic recovery ratio above 40% inclusive or, more preferably, above 50% inclusive or, more particularly, above 60% inclusive. Fibrous sheets of such a characteristic can exhibit not only a liquid absorption power, a power of recovery and a use life which all are remarkable, but also a high resistivity to deformation, so that they can provide a liquid absorbing apparatus having a long use life. The elastic recovery ratio termed above means the test result determined, according to the JIS-L-1096 method and with use of a "Tensilon" testing machine (product of Baldwin Co., Ltd.), by subjecting each test piece of 10 cm in length and 2 cm in width to a stretching test, repeated for 2 times, to a stretching ratio of 20%.

Further, the fibrous sheet for use in or for the present invention should have a liquid absorption power within the range of 1.0 to 5.0 or, more preferably, 1.2 to 5.0 or, more particularly, 1.3 to 4.0, and with use of a sheet satisfactory in respect of this required characteristic, it is feasible to obtain a remarkable initial liquid absorption power and, in addition thereto, a remarkable power of recovery and a remarkable use life. The liquid absorption power or capacity termed above means the weight increase ratio determined of each test sample of 30 cm $\times$30 cm in size in a manner such that after it was immersed in water for 1 hour, the test sample was subjected to a mangle-squeezing operated in a 4-time repetition, and thereafter it was again immersed in water, drawn out of the water, laid over on a filter paper for 3 seconds to have the water present on the surface of the test sample blotted, and immediately thereafter the weight of the test sample was measured. Thus, the liquid absorption power is represented by:

$$\text{Liquid absorption capacity} = \frac{\text{wet weight} - \text{dry weight}}{\text{dry weight}}$$

Using a fibrous sheet having an excessively small value of the liquid absorption power, its initial absorption power is poor. Using a sheet having an excessively great liquid absorption power, although it may exhibit an enhanced value of the initial absorption power, it is poor in the power of recovery and the use life, and fibrous sheets coming under these instances are not preferable.

Although no particular limitation is applicable to the high-polymeric elastic material for use for the preparation of the fibrous sheet, it is preferable to use polyurethane elastomer.

The above described fibrous sheet comprising a nonwoven fabric composed of three-dimensionally interlaced fibers and having an elastomer impregnated in the cavities in the nonwoven fabric can be easily prepared by any conventionally known method. For example, it may be obtained by processing fibers to a nonwoven fabric by any of needle punch methods, water jet methods, direct felting methods and so forth, and then applying a solution or dispersion of polyurethane elastomer to the above formed nonwoven fabric by impregnation or coating, followed by a wet coagulation treatment. If a super-fine denier fiber is used to provide a fibrous sheet, it may be operated to prepare a nonwoven fabric with use of fibers capable of being transformed into super-fine denier fibers such as for example multi-component fibers such as islands-in-a-sea type fibers, polymer blend type fibers, multi-layer type fibers, side-by-side type fibers and core-and-sheath type fibers, and then carry out in an appropriate sequence a transformation into super-fine denier fibers, an impregnation of polyurethane elastomer and a wet coagulation treatment. It is also possible to incorporate a knit fabric between two plies of a nonwoven fabric. The fibrous sheet may otherwise be obtained by firstly preparing a super-fine denier fiber, which is then formed into a nonwoven fabric, followed then by impregnation and wet coagulation of polyurethane, which may be operated in an appropriate sequence. Preferably, the fibrous sheet for the present invention is such a one as prepared by impregnating in a nonwoven fabric an elastomer in the form of a low concentration solution thereof, or a one prepared by impregnating in a nonwoven fabric a polymer to be temporarily impregnated in or coated on fibers prior to impregnation of the elastomer, and subsequently removing the polymer.

The above mentioned polymer to be temporarily impregnated or coated is not limited to any particular one insofar as the polymer is not identical with the elastomer, but from a practical point of view it should preferably be a water soluble one and most suitably be CMC (carboxymethyl cellulose) or PVA (polyvinyl alcohol).

Particularly where the nonwoven fabric is made of fibers capable of being transformed into super-fine denier fibers, it may be operated to impregnate a temporary adhesive agent into a mass of interlaced fibers and then impregnate a solution or dispersion of the elastomer, followed by a coagulation treatment and then by removal of the temporary adhesive agent, to produce a fibrous sheet, which is particularly preferable in that it can readily satisfy the preferred range respectively of the content of the high-polymeric elastic material or elastomer, the elastic recovery ratio and the liquid absorption power.

Whereas it is as stated above that the liquid absorbing apparatus of the invention exhibits a remarkable liquid absorption power on account of the capillary phenomenon, it is obvious that the capillary activity differs with different fibrous material.

Relating to the capillary activity, a comparison was conducted between the fibrous sheet used in or for the present invention and a conventionally utilized ordinary nonwoven fabric to obtain the following table.

| Sheet and Fabric | (mm) 10 min. | 20 min. | 30 min. | 60 min. |
|---|---|---|---|---|
| Fibrous sheet of the invention | 35 | 45 | 55 | 90 |
| Thickness: 3 mm<br>Weight: 600 g/m$^2$ | | | | |
| Ordinary nonwoven fabric | 35 | 35 | 35 | 35 |
| Thickness: 3 mm<br>Weight: 600 g/m$^2$ | | | | |

Notes:
1. The fibrous sheet of the invention was prepared by forming a nonwoven fabric from polyester fibers of 0.14 denier three-dimensionally interlaced and impregnating in the cavities of the nonwoven fabric polyurethane forming a microporous structure. The ratio of the specific gravity of the polyurethane to that of the fibers is 35:65.
2. The ordinary nonwoven fabric comprised polyester fibers of 6 denier.

The numerical data entered in the above table were obtained by immersing a portion of respective test samples in an aqueous solution of a coloring agent and, with the test samples kept in a normal position, measuring the height (mm) reached by the solution as a result of the capillary phenomenon.

As clearly seen from the above table, the fibrous sheet used in or for the absorption part according to the present invention exhibits a remarkably exceeding capillary activity.

The liquid absorbing apparatus according to the present invention is made by providing the above described fibrous sheet to an absorption part, and incorporating a suction mechanism to the absorption part. Whereas the absorption part to which the fibrous sheet is provided may be of any of configurations such as a roller, a belt, a sheet and so forth, preferably it should comprise a rotatable roller. The suction mechanism may comprise any suitable mechanism insofar as it can suck liquid from the absorption part comprising a fibrous sheet. For example, where the absorption part comprises a roller, it is expedient to provide a suction mechanism connected to a negative pressure source, to the interior or on an outer surface portion of the absorption part. In providing the suction mechanism inside the absorption part, the arrangement can be easily realized by making the inside of a cylindrical shaft of the roller absorption part a reduced pressure part.

Where the absorption part comprises a roller type one, another roller of the same or a different specification may be disposed opposite to the absorption part roller with space therebetween so that an object to be treated for removal of liquid therefrom can be nipped between the two rollers, whereby it advantageously is feasible to enhance the effect of the liquid removal.

FIG. 1 of the accompanying drawings represents a liquid absorbing apparatus embodying the present invention, in which the reference numeral 1 denotes a roller, composing a liquid absorption part comprising a fibrous sheet, which roller is provided on an outer surface portion thereof with a suction mechanism 4 connected to a negative pressure source (not shown). The suction mechanism 4 is so arranged as to positively remove liquid by suction from the absorption part over the outer surface of the roller 1. Opposite to the roller 1 of the absorption member, another roller 2 is disposed in an arrangement such that an object to be treated 3 can be nipped and, in that condition, passed between the two rollers 1 and 2, so that as the object 3 is passed between the rollers 1 and 2, liquid contained in this object 3 can be removed mainly by the roller 1.

Figure 2:
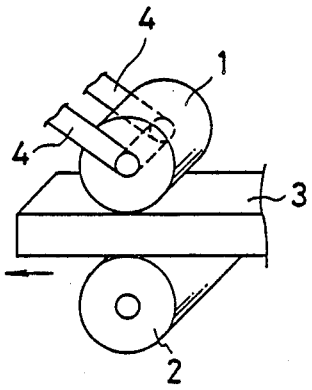
FIG. 2 is a perspective view, showing another embodiment of the apparatus according to the invention.

FIG. 2 represents another embodiment of the present invention, and in this embodiment, the suction mechanism 4 is connected to a shaft part of the roller 1 so that the liquid absorbed through the outer surface of the roller 1 can be removed by suction by the suction mechanism through the shaft part.

Figure 3:
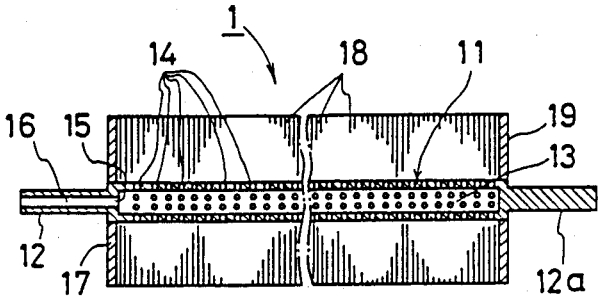
FIG. 3 is a longitudinal sectional view, showing an example of the roller constituting a member to or in the liquid absorbing apparatus of the invention.

FIG. 3 shows a preferred embodiment of the roller 1 suitable for use for or in the apparatus shown in FIG. 2. In the present FIG. 3, the reference numeral 11 denotes a cylindrical shaft having bearings 12 and **12*a* at the ends thereof, which includes an axially extending hollow part 13 formed in the peripheral wall thereof with a number of bores 14 communicated with the hollow part 13. One end of the shaft 11 is made an open end 15, which communicates with a through hole 16 formed in the bearing 12 and, through the hole 16, with suction means forming a negative pressure source such as a pump, cylinder or the like (not shown). Where a cylinder is employed for the suction mechanism, advantageously it may be devised to let the piston of the cylinder be received in the hollow part 13, make the bearing 12 having a relatively great diameter and, at the same time, provide a discharge opening to the bearing 12. The reference numeral 17 represents a side end plate fixed at one end of the shaft 11. In a manner of being compressed against this end plate 17, a number of fibrous sheets 18 which are cut to a disk-shape are piled one on another, and another end plate 19 is then fixed to the other end of the shaft 11, whereby the roller 1 is structured by a number of fibrous sheets or cuttings thereof 18 and side end plates 17 and 19**.

The roller provided with the absorption part may comprise disk-shaped fibrous sheets assembled by piling as shown in FIG. 3. Alternatively, it may be structured by winding a belt-shaped fibrous sheet on the shaft, and in this case, it should preferably be devised in order to obtain a uniform absorption performance, to apply an adhesive agent in dots, to employ a thermoplastic nonwoven fabric and apply a heat-press adhesion thereto, or to employ a sewing of a nonwoven fabric.

Where the absorption part should comprise a roller type one, such a roller is particularly preferable which comprises a number of disk-shaped fibrous sheets which are altogether piled as described above, for in this case not only it can be remarkable in respect of the initial liquid absorption power and the power of retaining or sustaining the absorption power but also it is unlikely to give rise to a damage on the surface of an object to be treated. Moreover, in this case it is not always necessary to set the ends of the fibrous sheets with use. of an adhesive agent, so that it is feasible to make uniform the peripheral surface of the roller. A further advantage is that simply by increasing the number of the fibrous sheet, the width of the roller can with ease be increased. Also, the roller has an extremely high stability against deformation, and even if the roller surface would be permitted to undergo a local damage after a long use of the roller, the damaged portion on the roller surface may be shaved or planed, simply whereby a desirable roller surface can again be obtained.

When the fibrous sheet is made with use of a superfine denier fiber, and if it in addition is met that a highpolymeric elastic material is impregnated in cavities of the sheet in a manner of providing a microporous structure, it is feasible to form extremely fine continuous micropores through the sheet, so that a desirable capillary activity can be brought about to endow a remarkable absorption power to the absorption part of the roller. In addition, by structuring the roller by plies of the disk-shaped fibrous sheet, fine voids or micropores can be provided without an interruption in the thickness or radial direction of the roller, so that the capillary phenomenon can be fully exhibited.

The capillary phenomenon can be further fully exhibited in the case of a fibrous sheet, composed of three-dimensionally interlaced bundles of super-fine denier fibers. It is considered that such fibrous sheet can more fully exhibit the capillary activity.

Because the roller according to the invention comprises the fibrous sheet containing the super-fine denier fiber and the high-polymeric elastic material, the roller surface can have a dense and fine structure and can be smooth, and an object to be treated can be effectively squeezed not only without any high nip pressure applied thereto but also uniformly without the risk of damaging the surface thereof. This advantage is particularly conspicuous when the fibrous sheet comprises super-fine denier fibers. If the fibrous sheet does not comprise a super-fine denier fiber but comprises a regular denier fiber, then the roller surface tends to be coarse, a considerable nip pressure is required to carry out an effective squeezing operation, giving rise to the generation of crease in the case of the object to be treated comprising a fiber product, and in addition, it can hardly be avoided to completely remove liquid from the surface of the object to be treated comprising a steel plate for example.

Such roller according to the present invention can be produced by processing, for example by cutting the fibrous sheet into disk-shaped sheets of a size as desired and piling a number of the disk-shaped sheets altogether to form a roller. When the roller is formed of a number of disk-shaped fibrous sheets, normally the piled sheets are compressed in the piling direction of the sheets to obtain a roller comprising mutually closely and densely arranged fibrous sheets.

The roller should preferably comprise a shaft provided in the center of the roller, made of a different material such as a metal and plastics, and the shaft should preferably be in the form of a pipe or tube having bores provided through the wall thereof for passage of liquid.

A roller having a shaft of a different material as above can be produced by piling disk-shaped fibrous sheets on the shaft and compressing the piled fibrous sheets altogether.

It may further be devised to wind a sheet type member having a high liquid absorption characteristic on a core comprising the above produced roller comprising a number of disk-shaped sheets piled altogether. The roller having such a cover comprising a sheet-like material, can be prevented from a damage such that the core is permitted to undergo clogging and its diameter is reduced due to any damage caused by the object to be treated and/or a facial deformation. Thus, the liquid absorbing apparatus can continue to exhibit a remarkable liquid absorption power for a long period of use time with the configuration of the core kept intact.

Figure 4:
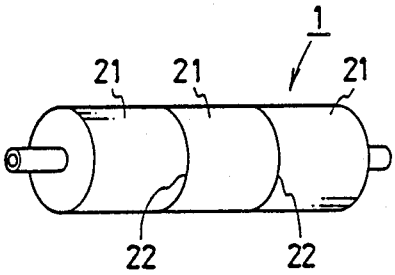
FIG. 4 is a perspective view, showing another example of the roller in the apparatus of the invention.

Then, as shown in FIG. 4, it may further be devised to incorporate liquid impermeable disk-shaped sheets 22 at appropriate intervals in the width of axial direction of the roller produced as above and comprising a number of altogether piled disk-shaped fibrous sheets, when the roller can be made comprising a plurality of independent roller portions 21, . . . , 21, and since liquid is then prevented from transferring from a first roller portion 21 to a second one 21, it is possible to treat by a single roller or a single pair of rollers a plurality of or a number of elongate objects to be treated at a same time, or to carry out the liquid removal operation at a high efficiency in a manner of spirally winding an elongate object to be treated in plies on the roller.

If disk-shaped sheets having a great liquid permeability are used in place of the above disk-shaped sheets 22 having no liquid permeability, it is possible to permit different degrees of liquid transfer to take place on the roller surface depending on the difference in the liquid holding capacity of the respective sheets, whereby the liquid absorption power and the power retentivity or the power to sustain the absorption power as well can be greatly improved. In addition to a reduction in the cost of energy required for the operation which can then be realized, an intended object for the treatment can be treated without the risk of its surface becoming damaged. For the sheet having a great liquid permeability, use may be made of not only any of liquid permeable matters such as ordinary natural sponge, papers, fabrics, cotton-like webs and so forth made of natural or synthetic fibers, but also even such matters which are inherently substantially liquid impermeable, for example rubber and plastics, providing that they are formed with a number of continuous pores and thus made liquid permeable.

The roller having a liquid absorbing surface formed of a fibrous sheet according to the present invention may be provided with a transportation means to provide such a mobile liquid removing apparatus which is particularly useful in or for removing a liquid such as water remaining present on a ground surface, a court surface or a floor surface.

Figure 5:
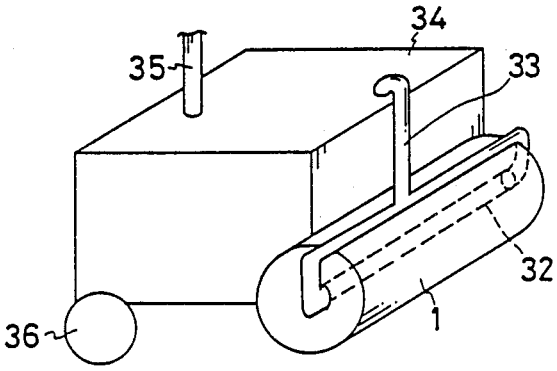
FIG. 5 is a perspective view, representing a still another embodiment of the present invention and illustrating a liquid removing apparatus adapted to be mobile.

FIG. 5 shows an embodiment of such mobile liquid removing apparatus according to the invention, which comprises a roller 1 made of a cylindrical shaft 32 formed with a number of bores through the wall thereof and covered with a fibrous sheet, and a liquid collector tank 34 functioning also as a carriage for the roller. The tank 34 is provided with wheels 36 and is movable. The cylindrical shaft 32, which constitutes a suction mechanism, is communicated with the liquid collector tank 34 through a tube or hose 33 and further with a negative pressure source (not shown) through a tube or hose 35.

With this liquid removing apparatus, the liquid that the roller 1 has absorbed is sucked through the hose 33 and collected in the tank 34.

The mobile liquid removing apparatus can remove away a great volume of liquid remaining on a ground or a court surface, a floor surface or the like with ease in a short period of time, and can be effectively used for a long time operation.

The present invention may further otherwise be embodied for example in a manner such that a flat fibrous sheet is attached to a suction mouth: For example, such a fibrous sheet may be attached as a liquid absorption member to the suction mouth of a vacuum cleaner.

EXAMPLE 1

A 3-denier 2-component islands-in-a-sea type fiber (the island component: polyethylene terephthalate, 50 wt.%, 36 super-fine filamentary island components; the sea component: polystyrene, 50 wt.%) was processed to fibers of about 51 mm for the cut length and about 14 crimps/inch, which were then formed by needle punching into a nonwoven fabric of a weight of 580 g/m$^2$. This fabric was passed through an aqueous 10% solution of polyvinyl alcohol maintained at 98° C., squeezed to obtain 35 wt.% (based on the island component), dried and, with the sea component then removed away by resolving it in triclene, dried at 100° C. to obtain a sheet.

The above obtained sheet was impregnated with a dimethylformamide solution of polyurethane (15 wt.%) and subjected to a wet coagulation in water. Then, with polyvinyl alcohol removed in hot water maintained at 90° C., the sheet was dried at 100° C. to obtain a fibrous sheet having values as shown in the below Table 1 for the denier of fibers, the content of polyurethane, the elastic recovery ratio and the liquid absorption power.

A liquid absorbing apparatus was structured by winding the above obtained fiber material sheet on a roller as liquid absorption part, providing a suction mechanism inside a shaft of the roller, and disposing a pair of such rollers in an opposed arrangement. An acrylic fiber blanket was immersed in water, and with this blanket as object to be treated, a liquid removal was operated by the above liquid absorbing apparatus. As a result of this, a highly remarkable liquid removing effect was obtained such that as shown in Table 1, the water content of the treated blanket was 82%.

EXAMPLE 2

Except that the fiber used in this Example comprised a 3-denier 2-component islands-in-a-sea type fiber having 57/43 for the weight ratio of the island component and the sea component and 16 super-fine filamentary island components, the above Example 1 was repeated to obtain a fibrous sheet having values as shown also in Table 1 for the denier of fibers, the content of polyurethane, the elastic recovery ratio and the liquid absorption power. With use of this sheet, a same liquid absorbing apparatus as in Example 1 was fabricated. A same treatment of an acrylic fiber blanket as in Example 1 was operated to obtain a highly remarkable liquid removing attainment such that the water content in the treated blanket was so low as to be 67%.

EXAMPLE 3

Except that the fiber used in this Example comprised a 3-denier 2-component islands-in-a-sea type fiber having 80/20 for the weight ratio of the island component and the sea component and 16 super-fine filamentary island components, the Example 1 was repeated to obtain a fibrous sheet having values as shown in Table 1 for the denier of fibers, the content of polyurethane, the elastic recovery ratio and the liquid absorbing power. Using the fibrous sheet, a same liquid absorbing apparatus as in Example 1 was fabricated. A same treatment of an acrylic fiber blanket as in Example 1 was operated to meet a highly remarkable liquid absorbing attainment such that the water content in the treated blanket was so low as to be 70%.

EXAMPLE 4

The same 2-component islands-in-a-sea type fiber as used in Example 2 was processed to fibers of about 51 mm for the cut length and about 14 crimps/inch, which were then formed by needle punching into a nonwoven fabric of a weight of 580 g/m$^2$. This fabric was impregnated with a dimethylformamide solution of polyurethane (15 wt.%) and then subjected to a wet coagulation in water to obtain a fibrous sheet having values as shown in Table 1 for the denier of fibers, the content of polyurethane, the elastic recovery ratio and the liquid absorption power. Using the fibrous sheet, a same liquid absorbing apparatus as in Example 1 was fabricated. A same treatment of an acrylic fiber blanket as in Example 1 was operated to find that the water content in the treated blanket was 86%.

EXAMPLE 5

A 3-denier 2-component islands-in-a-sea type fiber (the island component: polyamide, 60 wt.%; the sea component: polystyrene, 40 wt.%) was processed to fibers of about 51 mm for the cut length and about 14 crimps/inch, which were then formed by needle punching into a nonwoven fabric of a weight of 580 g/m$^2$. This fabric was impregnated with a dimethylformamide solution of polyurethane (15 wt.%) and then subjected to a wet coagulation in water. The sea component in the fabric was dissolved and removed away in triclene, followed by drying at 100° C. to obtain a fibrous sheet having values as shown in Table 1 for the denier of fibers, the content of polyurethane, the elastic recovery ratio and the liquid absorption power.

Using the above obtained fibrous sheet, a same liquid absorbing apparatus as in Example 1 was fabricated, and a same treatment of an acrylic fiber blanket as in Example 1 was operated to find that the water content in the treated blanket was 106%.

EXAMPLE 6

A 1.0-denier polyethylene terephthalate fiber was processed to fibers of about 51 mm for the cut length and about 14 crimps/inch, which were then formed by needle punching into a nonwoven fabric of a weight of 580 g/m$^2$. This fabric was impregnated with a dimethylformamide solution of polyurethane (15 wt.%) and then subjected to a wet coagulation in water, followed by drying to obtain a fibrous sheet having values as shown in Table 1 for the denier of fibers, the polyurethane content, the elastic recovery ratio and the liquid absorption power. Using this fibrous sheet, a same liquid absorbing apparatus as in Example 1 was fabricated and a same treatment of an acrylic fiber blanket as in Example 1 was operated to find that the water content in the treated blanket was 94%.

EXAMPLE 7

Except that in this Example a dimethylformamide solution of polyurethane (2 wt.%) was used, Example 2 was repeated to obtain a fibrous sheet having values as shown in Table 1 for the denier of fibers, the polyurethane content, the elastic recovery ratio and the liquid absorption power. Using the fibrous sheet, a same liquid absorbing apparatus as in Example 1 was fabricated, and a same treatment of an acrylic fiber blanket as in Example 1 was operated to find that the water content in the treated blanket was 117%.

TABLE 1

| | Example | | | | | | |
|---|---|---|---|---|---|---|---|
| | 1 | 2 | 3 | 4 | 5 | 6 | 7 |
| Fibrous Sheet | | | | | | | |
| Denier of fibers (denier) | 0.04 | 0.14 | 0.19 | 0.005~0.01 | 0.4 | 1.0 | 0.14 |
| Polyurethane content (wt. % based on fibers) | 30 | 45 | 18 | 60 | 40 | 43 | 3 |
| Elastic recovery ratio (%) | 70 | 70 | 60 | 48 | 52 | 50 | 30 |
| Liquid absorption power | 2.0 | 2.2 | 2.4 | 1.2 | 1.5 | 1.0 | 3.0 |
| Treated object | | | | | | | |
| Acrylic fiber blanket, Water content found (%) | 82 | 67 | 70 | 114 | 106 | 94 | 117 |

Notes:
(1) Test conditions
Blanket feed velocity: 20 m/min
Liner pressure: 9.6 kg/cm
Squeezing operation repeated: One (1) time
(2) Water content found (%) $= \frac{W_2 - W_1}{W_1} \times 100$
$W_1$: Weight of the blanket in dry condition
$W_2$: Weight of the blanket after it was immersed in water and treated for water removal

EXAMPLE 8 AND COMPARATIVE EXAMPLES 1 AND 2

From the fibrous sheet obtained in Example 2 (3 mm thick) comprising a nonwoven fabric or three-dimensionally interlaced super-fine denier fibers of polyester and having polyurethane impregnated in cavities of the fabric in a manner of providing a microporous structure, a number of disk-shaped sheets of 250 mm in the outer diameter and 150 mm in the inner diameter were prepared and put one another in a piled layer at a pressure of 50 kg/cm$^2$ to form a roller with a metal shaft. The ends of the pile of disk-shaped sheets were fixed, and then the roller surface was subjected to abrasion to effect a centering and smoothing of the surface to finally obtain a liquid absorption roller.

Using a pair of the above obtained roller and by providing a suction mechanism on a roller surface portion, a liquid absorbing apparatus as shown in FIG. 1 was provided (Example 8).

Woven fabrics of a polyester fiber were immersed in water and put for tests to determine the effect of water removing with use of the above provided liquid absorbing apparatus and comparable effects with use of a device (Comparative Example 1) comprising a roller made of a conventionally known nonwoven fabric of ordinary fibers (1-denier fibers and 5-denier fibers mixed at a ratio of 1:1, having 0 for the polyurethane content, 35% for the elastic recovery ratio and 5.0 for the liquid absorption power) and also of a device comprising a rubber (Comparative Example 2). The below Table 2 shows the test results.

TABLE 2

| Woven fabrics | Squeezing repeated | Example 8 | Comparative Examples 1 | Comparative Examples 2 |
|---|---|---|---|---|
| Processed polyester yarn fabric texture: sateen weave (cashmere doeskin) weight: 230 g/m$^2$ | 3 times | 20 | 35 | 40 |
| Polyester yarn fabric texture: plain weave (Habutae) weight: 80 g/m$^2$ | 2 times | 10 | 20 | 30 |

TABLE 2-continued

Notes:
(1) Test conditions
Fabric feed velocity: 40 m/min
Linear pressure: 6 kg/cm
Squeezing operation repeated: 2 and 3 times
(2) Water content found (%) $= \frac{W_2 - W_1}{W_1}$
$W_1$: Weight of the fabrics in dry condition
$W_2$: Weight of the fabrics after they were immersed in water and then squeezed in repetition by the prescribed numbers.

As seen from the above Table 2, the liquid removing effect attained with use of the liquid absorbing apparatus according to the present invention exceeded the comparable effects with use of the device comprising a roller of a nonwoven fabric made of ordinary fibers and with use of the device comprising a rubber roller.

Also, with use of the apparatus according to the invention, an attempt was made to remove the layer of liquid remaining after a surface treatment of a metal plate to find that the liquid layer on the metal plate surface could be completely removed at such a limited linear pressure as being within the range of 3 to 6 kg/cm. Contrary to this, with use of the device comprising a rubber roller, a hydroplane phenomenon was produced regardless of changes made in the applied pressure and it was infeasible to completely remove the layer of the liquid on the surface of the metal plate.

Then, with use of the device comprising a roller of a nonwoven fabric made of ordinary fibers, it was impossible to remove the liquid on the metal plate surface at a small linear pressure within the range of 3 to 16 kg/cm, and when the applied pressure was increased, the roller was prone to undergo a damage in contact against edges of the metal plate, whereby it was infeasible to obtain a desirable result.

In each of the above described tests for removal of water from fabrics and removal of the liquid remaining on the metal plate surface, the liquid absorbing apparatus according to the present invention could stand a use for a long period of time without undergoing a change with the lapse of time and could sustain a stable and uniform operation efficiency.

EXAMPLE 9 AND COMPARATIVE EXAMPLES 3 AND 4

From the fibrous sheet obtained in Example 2 (2 mm thick) comprising a nonwoven fabric made of three-dimensionally interlaced super-fine denier fibers of polyester and also a T/C (polyester/cotton) woven fabric (0.36 mm thick), a number of disk-shaped sheets of 250 mm in the outer diameter and 150 mm in the inner diameter were prepared and put one another in a piled layer to form a roller, with each of the fibrous sheet and the T/C fabric sheets used in the form of 3-ply units, on a metal-made shaft at a pressure of 50 kg/cm$^2$. The ends of the pile of the disk-shaped sheets were fixed and then the roller surface was subjected to abrasion to effect a centering and a smoothing of the surface to thereby obtain a liquid absorption roller.

Using a pair of the above obtained roller and by providing a suction mechanism on a roller surface portion, a liquid absorbing apparatus as shown in FIG. 1 was provided (Example 9).

Then, for a Comparative Example 3, use was made of a liquid absorbing apparatus comprising a roller made of the fibrous sheet alone was used, while for a Comparative Example 4, use was made of a liquid absorbing apparatus comprising a roller made of a conventionally known nonwoven fabric of ordinary fibers was used, and comparative tests were carried out to determine the water removing efficiency of the respective apparatuses in connection with an acrylic fiber blanket and a polyester fiber woven fabric, which were immersed in water and then put for the tests. The test results are shown in Table 3 below.

TABLE 3

| | Example 9 | | Comparative Examples 3 | Comparative Examples 4 |
|---|---|---|---|---|
| Degree of suction (mmHg) | 250 | 550 | 550 | 550 |
| Acrylic fiber blanket boa type weight: 476 g/m$^2$ | 83 | 80 | 87 | 97 |
| T/C woven fabric (T/C = 65/35) texture: plain weave (poplin) weight: 208 g/m$^2$ | 50 | 44 | 50 | 56 |

Notes:
(1) Test conditions
Fabric feed velocity: 20 m/min
Linear pressure: 9.6 kg/cm
Squeezing operation repeated: One (1) time
(2) Water content found (%) $= \frac{W_2 - W_1}{W_1}$
$W_1$: Weight of the blanket and fabric in dry condition
$W_2$: Weight of the blanket and fabric after they were immersed in water and then subjected to the water removal treatment As shown in the above Table 3, using the liquid absorbing apparatus according to the invention, better results of the water removal were obtained in comparison to the case using the device comprising the nonwoven fabric of ordinary fibers.

Also, in comparison to the case of the apparatus comprising the roller made of fibrous sheet alone, the result obtained in the case of the apparatus according to the present invention was of an exceeding degree even under a lower degree of the suction.

EXAMPLE 10

A fibrous sheet comprising a nonwoven fabric of three-dimensionally interlaced polyester fibers and having polyurethane impregnated in cavities of the nonwoven fabric in a manner of providing a microporous structure was wound in plies on a porous metal-made cylindrical shaft of 100 mm in the outer diameter to provide a liquid absorption roller, and by providing to this roller a suction mechanism connected through a drainage hose to a water collector tank having wheels, a mobile water removing apparatus was built. Using this water removing apparatus, tests were operated to remove water remaining on surfaces of a putting green on a golf course and of a chemical coating on a tennis court to find it possible to efficiently effect the removal of water at such a low suction capacity as to be −50 mmHg for the degree of suction. Also, a test was conducted to remove water scattered on the surface of a concrete floor in a factory to obtain a remarkable result such that after the water removal operation under a small suction capacity of −50 mmHg for the degree of suction, convex surface portions on the floor surface showed 0% for the moisture content as found with use of a moisture detection paper.

Possible Industrial Utility of the Invention

In accordance with the present invention, the liquid absorption part comprising a fibrous sheet permits the liquid thereby absorbed to smoothly migrate inwardly of this part, so that the liquid absorption surface thereof can be always maintained in a condition capable of exhibiting a high power of liquid absorption, and such liquid absorption part is operatively associated with a suction mechanism, so that the degree of the liquid absorption power can be enhanced. Therefore, the liquid absorbing apparatus according to the invention can exhibit a remarkable liquid removing power and a remarkable retentivity of the liquid absorption power and make it feasible to effect a uniform squeezing of an object to be removed of liquid contained therein, without the risk of damaging the surface of the object. Accordingly, the apparatus of the invention is highly effectively useful for removing a liquid such as water, treating liquids and so forth contained in or remaining on surfaces of for example metal products, glass, plates, fiber products, rubber products, plastic products, or a ground or court surface, a floor surface and like surfaces.

We claim:

1. A liquid removing apparatus comprising:

a liquid absorption part, said liquid absorption part being provided with a fibrous sheet which comprises a nonwoven fabric composed of three-dimensionally interlaced fibers and a high-polymeric elastic material impregnated in cavities of the nonwoven fabric, said nonwoven fabric comprising super-fine denier fiber having a finess below 0.4 inclusive for the monofilament denier, said high-polymeric elastic material has a content in said nonwoven fabric of 10 to 80 wt. % based on the fibers; and a suction mechanism being provided with said liquid absorption part, so as to absorb liquid into said liquid absorption part.

2. Apparatus as claimed in claim 1, wherein said liquid absorption part is in the form of a roller and wherein said suction mechanism is provided inside an axial portions of said roller.

3. Apparatus as claimed in claim 1, wherein said liquid absorption part is in the form of a roller provided with said suction mechanism on an outer surface portion thereof.

4. Apparatus as claimed in claim 1, wherein the superfine denier fiber is in bundles.

5. Apparatus as claimed in claim 1, wherein said fibrous sheet has an elastic recovery ratio above 40% inclusive.

6. Apparatus as claimed in claim 1, wherein said fibrous sheet has a liquid absorption power of 1.0 to 5.0.

7. Apparatus as claimed in claim 2 or 3, wherein said liquid absorption part in the form of a roller is composed of a number of disk-shaped fibrous sheets put one another in a piled layer to form the roller.

8. Apparatus as claimed in claim 2 or 3, wherein said roller having said liquid absorption part is operatively associated with an opposingly disposed roller of a same or different specification.

9. Apparatus as claimed in claim 7, wherein said roller composed of disk-shaped fibrous sheets put one another in a piled layer is covered over the surface thereof with an outer layer fibrous sheet comprising a sheet-form material having a high liquid absorbing capacity.

10. Apparatus as claimed in claim 7, wherein said roller composed of disk-shaped fibrous sheets includes liquid impermeable disk-shaped sheets interposed at appropriate intervals.

11. Apparatus as claimed in claim 7, wherein said roller composed of disk-shaped fibrous sheets includes disk-shaped sheets having a greater liquid permeability than the fibrous sheet, interposed at appropriate intervals.

12. Apparatus as claimed in claim 7, wherein said roller composed of disk-shaped fibrous sheets is provided in an axis with a cylindrical shaft having a number of through holes in the wall thereof, said shaft being connected to a negative pressure source to form said suction mechanism.

13. Apparatus as claimed in claim 1, wherein said liquid absorption part is in the form of a roller, which is attached to a liquid collector tank in a manner of forming a wheel whereby the apparatus is made a mobile one.

* * * * *